US011781804B2

(12) United States Patent
Culley

(10) Patent No.: US 11,781,804 B2
(45) Date of Patent: Oct. 10, 2023

(54) REFRIGERATOR APPLIANCE HAVING A CHILLED DISPENSING ASSEMBLY

(71) Applicant: Haier US Appliance Solutions, Inc., Wilmington, DE (US)

(72) Inventor: Brian Culley, Newburgh, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 101 days.

(21) Appl. No.: 17/376,799

(22) Filed: Jul. 15, 2021

(65) Prior Publication Data

US 2023/0017587 A1 Jan. 19, 2023

(51) Int. Cl.

| | |
|---|---|
| ***F25D 23/02*** | (2006.01) |
| ***F25D 23/12*** | (2006.01) |
| ***F25C 5/182*** | (2018.01) |

(52) U.S. Cl.

CPC ..... *F25D 23/126* (2013.01); *F25C 5/182* (2013.01); *F25D 23/028* (2013.01); *F25C 2700/04* (2013.01); *F25D 2323/122* (2013.01)

(58) Field of Classification Search

CPC ..... F25D 23/02; F25D 23/028; F25D 23/126; F25D 2323/122; F25D 2331/806

See application file for complete search history.

(56) References Cited

U.S. PATENT DOCUMENTS

| | | | | |
|---|---|---|---|---|
| 5,819,547 | A * | 10/1998 | Oh | F25D 23/126 141/DIG. 1 |
| 6,574,984 | B1 * | 6/2003 | McCrea | F25D 23/126 222/146.6 |
| 6,810,682 | B1 | 11/2004 | Ott | |
| 7,658,212 | B2 | 2/2010 | Karl | |
| 9,302,897 | B2 | 4/2016 | Dherde | |
| 10,233,070 | B2 | 3/2019 | Comsa | |
| 10,584,908 | B2 | 3/2020 | Kim | |
| 2012/0227434 | A1 * | 9/2012 | Kim | F25D 23/126 62/344 |
| 2016/0176698 | A1 | 6/2016 | Lee | |
| 2021/0041158 | A1 * | 2/2021 | Frattini | F25D 11/02 |

FOREIGN PATENT DOCUMENTS

| | | | | |
|---|---|---|---|---|
| MY | 192432 A * | 8/2022 | | E06B 3/70 |

OTHER PUBLICATIONS

KR 2012-0126182 (English translation) (Year: 2012).*

* cited by examiner

*Primary Examiner* — Jonathan Bradford
(74) *Attorney, Agent, or Firm* — Dority & Manning, P.A.

(57) ABSTRACT

A refrigerator appliance or door assembly may include an enclosing body, a liquid reservoir, a level sensor, a water valve, and a liquid dispenser. The enclosing body may define an exterior surface and an interior surface. The liquid reservoir may be defined within the enclosing body between the exterior surface and the interior surface. The level sensor may be mounted to the liquid reservoir. The level sensor may be configured to detect a water volume within the liquid reservoir. The water valve may be mounted upstream from the liquid reservoir to selectively direct water thereto based on the detected water volume. The liquid dispenser may extend from the liquid reservoir and through the interior surface to an outlet aperture to selectively dispense water from the liquid reservoir.

20 Claims, 3 Drawing Sheets

REFRIGERATOR APPLIANCE HAVING A CHILLED DISPENSING ASSEMBLY

FIELD OF THE INVENTION

The present subject matter relates generally to refrigerator appliances, and more particularly to refrigerator appliances having a dispensing assembly.

BACKGROUND OF THE INVENTION

Refrigerator appliances generally include a cabinet that defines a chilled chamber for receipt of food articles for storage. Refrigerator appliances can also include a dispenser assembly mounted to the front of a single door for directing ice from the refrigerator's ice maker or liquid water to the region in front of the door. A user can activate the dispenser to direct a flow of ice or liquid water into a cup or other container positioned below the dispenser. Liquid water dispensed by the dispenser is generally chilled or at provided at an ambient temperature. In the case of chilled water dispensing, a tank or extended length of tubing may store a volume of water, for instance, near an evaporator or chilled chamber within the cabinet. As a result, water may be cooled prior to being dispensed from the front of the door.

However, challenges exist with typical refrigerator appliances. As an example, the area for a dispenser is generally limited. Specifically, the area to receive vessels, cups, or containers below the dispenser is often limited to a small sub-portion of a single door, which may thus have difficulty accommodating large vessels, cups, or containers. Moreover, in the case of conventional designs for chilling water, extensive space within the cabinet is generally required. Additionally or alternatively, an elaborate arrangement or control system may be required for a providing water within close proximity, for example, to an evaporator. Even with such demanding designs, difficulties often arise with providing an adequate volume of chilled water at a given moment.

As a result, assemblies or appliances addressing one or more of the above issues would be useful. As an example, it may be advantageous to provide an assembly or appliance capable of accommodating a wide variety of vessel sizes, shapes, or volumes. As an additional or alternative example, it may be advantageous to provide an assembly or appliance capable of efficiently or reliably supplying chilled water to a user (e.g., at relatively large volumes or without requiring significant sacrifices to complexity, cost, or chilled storage space).

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a door assembly for a refrigerator appliance is provided. The door assembly may include an enclosing body, a liquid reservoir, a level sensor, a water valve, and a liquid dispenser. The enclosing body may define an exterior surface and an interior surface. The liquid reservoir may be defined within the enclosing body between the exterior surface and the interior surface. The level sensor may be mounted to the liquid reservoir. The level sensor may be configured to detect a water volume within the liquid reservoir. The water valve may be mounted upstream from the liquid reservoir to selectively direct water thereto based on the detected water volume. The liquid dispenser may extend from the liquid reservoir and through the interior surface to an outlet aperture to selectively dispense water from the liquid reservoir.

In another exemplary aspect of the present disclosure, a refrigerator appliance is provided. The refrigerator appliance may include a cabinet, an enclosing body, a liquid reservoir, a level sensor, a water valve, and a liquid dispenser. The cabinet may define a chilled chamber. The enclosing body may be mounted to the cabinet. The enclosing body may define an exterior surface directed away from the chilled chamber and an interior surface directed toward the chilled chamber. The liquid reservoir may be defined within the enclosing body between the exterior surface and the interior surface. The level sensor may be mounted to the liquid reservoir. The level sensor may be configured to detect a water volume within the liquid reservoir. The water valve may be mounted within the refrigerator appliance upstream from the liquid reservoir to selectively direct water thereto based on the detected water volume. The liquid dispenser may extend from the liquid reservoir and through the interior surface to an outlet aperture to selectively dispense water from the liquid reservoir.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
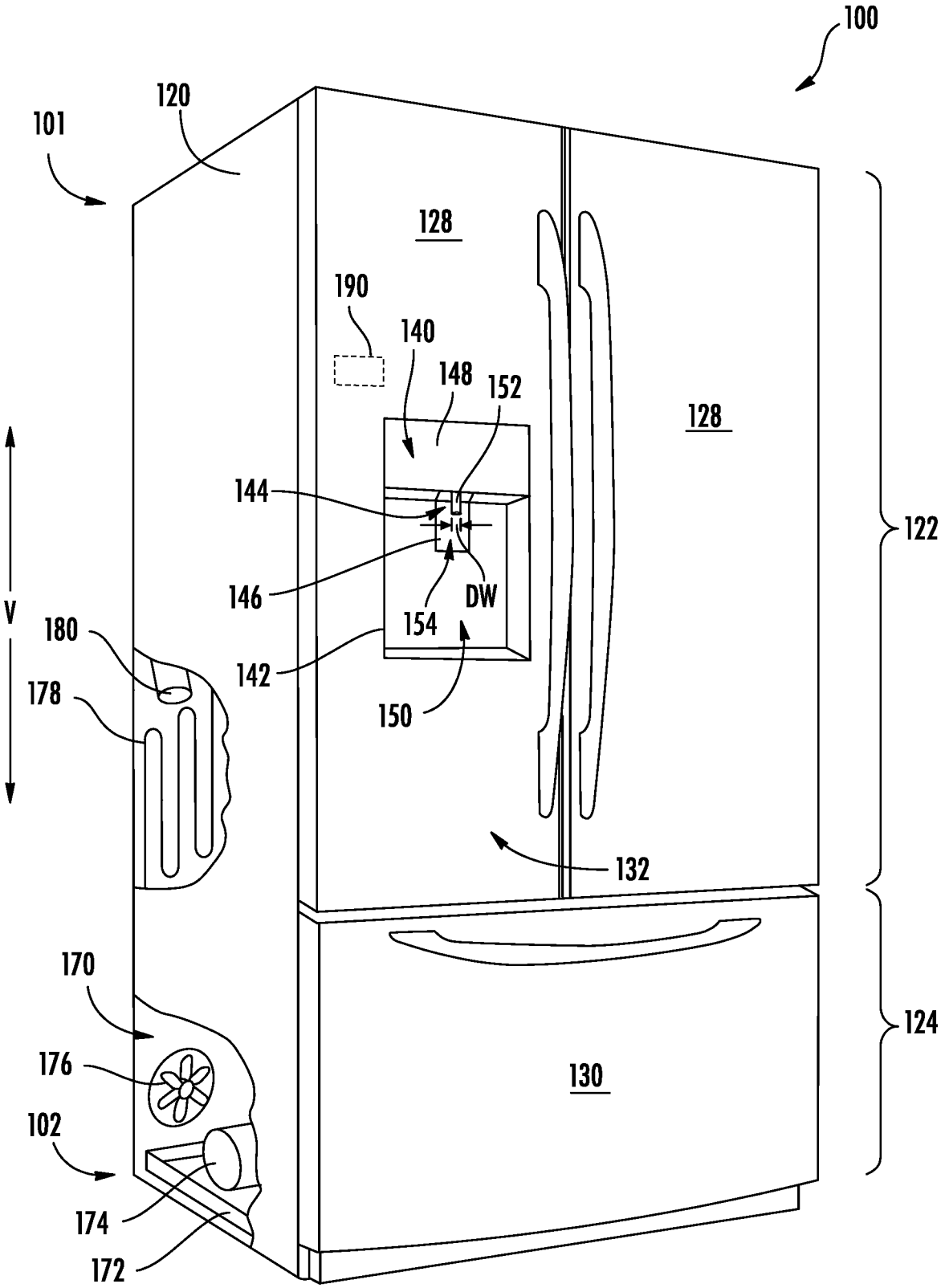
FIG. 1 provides a perspective view of a refrigerator appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view of a refrigerator appliance 100 according to an exemplary embodiment of the present disclosure. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines fresh food chamber 122 positioned at or adjacent top portion 101 of housing 120 and a freezer chamber 124 arranged at or adjacent bottom portion 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular chilled chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in a closed configuration in FIG. 1.

Figure 2:
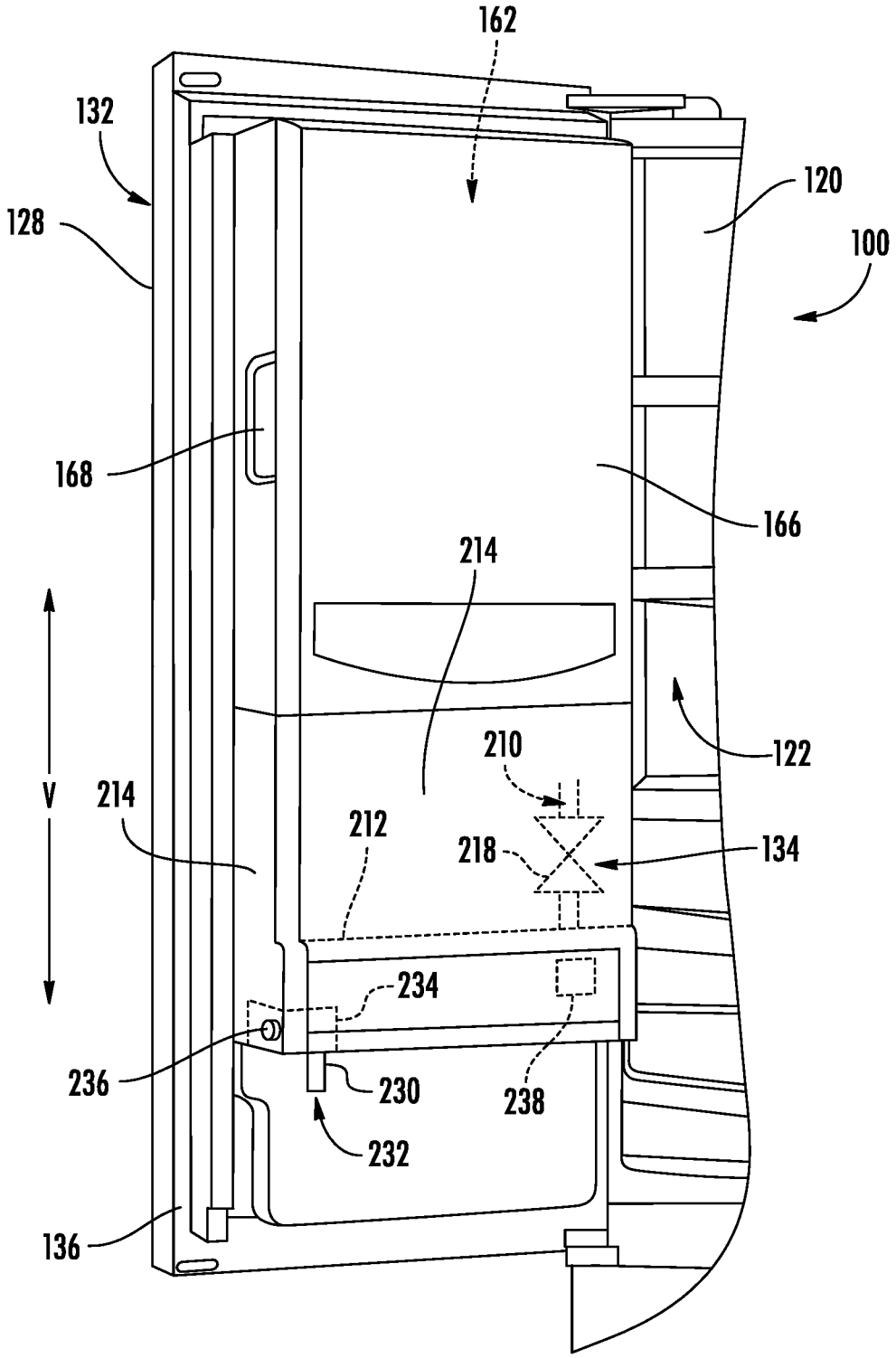
FIG. 2 provides a perspective view of a door of the exemplary refrigerator appliance of FIG. 1.

Refrigerator door 128 includes an enclosing body 136 that is formed from one or more panels or frame members, as would be understood. When assembled, enclosing body 136 defines an exterior surface 132 and an opposite interior surface 134 (FIG. 2). Generally, exterior surface 132 is directed outward, away from fresh food chamber 122. In turn, exterior surface 132 is generally visible by a user facing refrigerator appliance 100 (e.g., when refrigerator door 128 is in the closed position). By contrast, interior surface 134 may be defined proximal to and face fresh food compartment 122. Thus, interior surface 134 may be hidden from a user's view or access until refrigerator door 128 is opened.

Refrigerator appliance 100 also includes a dispensing assembly 140 for dispensing liquid water or ice. Dispensing assembly 140 includes a dispenser 142 positioned on or mounted to an exterior portion of refrigerator appliance 100, e.g., on or extending through exterior surface 132. Dispenser 142 includes a discharging outlet 144 for accessing ice and liquid water. In particular, a water dispenser 152 (e.g., formed from a suitable water tube or conduit) defining a water outlet 154 may be disposed through discharging outlet 144, and thereby through exterior surface 132. As would be understood, water dispenser 152 may be in fluid communication with a water source (e.g., municipal water supply, well, etc.) connected to refrigerator appliance 100 via one or more connection lines or pipes. Water may thus be selectively dispensed to the dispenser recess 150 at exterior surface 132 from the water outlet 154.

An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Operation of the refrigerator appliance 100 can be regulated by a controller 190 that is operatively coupled to user interface panel 148 or various other components, as will be described below. User interface panel 148 provides selections for user manipulation of the operation of refrigerator appliance 100 such as e.g., selections between whole or crushed ice, chilled water, or other various options. In response to user manipulation of user interface panel 148 or one or more sensor signals, controller 190 may operate various components of the refrigerator appliance 100. Controller 190 may include a memory and one or more microprocessors, CPUs or the like, such as general or special purpose microprocessors operable to execute programming instructions or micro-control code associated with operation of refrigerator appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog or digital logic circuitry (such as switches, amplifiers, integrators, comparators, flip-flops, AND gates, and the like) to perform control functionality instead of relying upon software.

Controller 190 may be positioned in a variety of locations throughout refrigerator appliance 100. In the illustrated embodiment, controller 190 is located within the user interface panel 148. In other embodiments, the controller 190 may be positioned at any suitable location within refrigerator appliance 100, such as for example within a fresh food chamber, a freezer door, etc. Input/output ("I/O") signals may be routed between controller 190 and various operational components of refrigerator appliance 100. For example, user interface panel 148 may be in communication with controller 190 via one or more signal lines or shared communication busses.

As illustrated, controller 190 may be in communication with the various components of dispensing assembly 140 and may control operation of the various components. For example, the various valves, switches, etc. may be actuatable based on commands from the controller 190. As discussed, interface panel 148 may additionally be in communication with the controller 190. Thus, the various operations may occur based on user input or automatically through controller 190 instruction.

Figure 3:
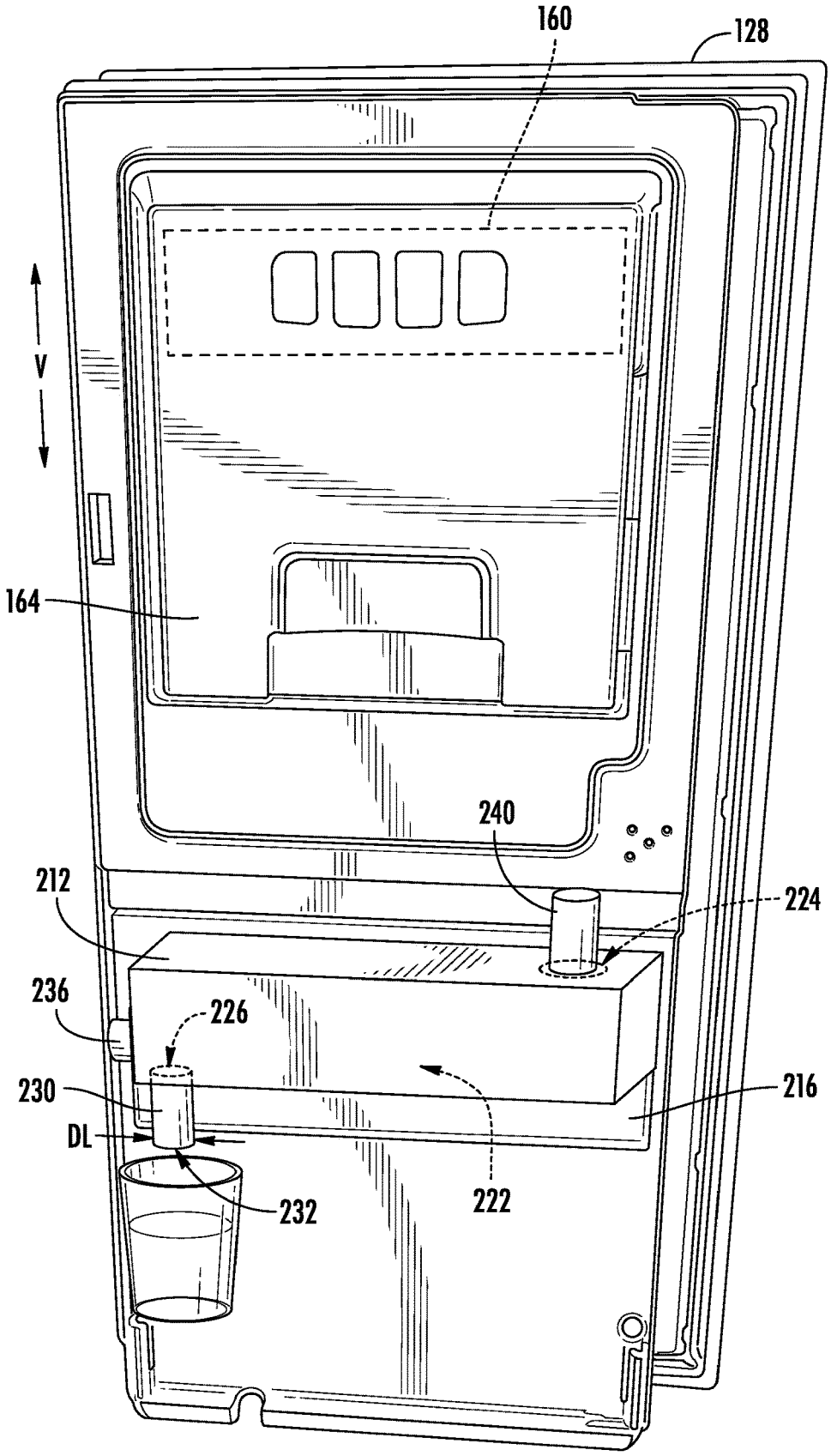
FIG. 3 provides another perspective view of the exemplary door of FIG. 2, apart from the refrigerator appliance and wherein an interior panel has been removed for clarity.

FIG. 2 provides a perspective view of a door of refrigerator doors 128. FIG. 3 provides an elevation view of refrigerator door 128 with an access door 166 and outer panel removed for clarity. Refrigerator appliance 100 includes a sub-compartment 162 defined on refrigerator door 128. Sub-compartment 162 is often referred to as an "icebox." Moreover, sub-compartment 162 extends into fresh food chamber 122 when refrigerator door 128 is in the closed position.

An icemaker or ice-making assembly 160 or an ice storage bin 164 may be positioned or disposed within sub-compartment 162. Thus, ice is supplied to dispenser recess 150 (FIG. 1) from ice-making assembly 160 or ice storage bin 164 in sub-compartment 162 on a back side of refrigerator door 128. Chilled air from a sealed system of refrigerator appliance 100 may be directed into ice-making assembly 160 in order to cool components of ice-making assembly 160. In particular, an evaporator 178, e.g., that is positioned at or within fresh food chamber 122 or freezer chamber 124, is configured for generating cooled or chilled air. A supply conduit 180, e.g., that is defined by or positioned within housing 120, may extend between evaporator 178 and components of ice-making assembly 160 in order to cool components of ice-making assembly 160 and assist ice formation by ice-making assembly 160.

During operation of ice-making assembly 160, chilled air from the sealed system cools components of ice-making assembly 160 to or below a freezing temperature of liquid water. Thus, ice-making assembly 160 is an air cooled ice-making assembly. Chilled air from the sealed system may also cools ice storage bin 164. In addition, ice-making assembly 160 may also be exposed to air having a temperature above the freezing temperature of liquid water. As an example, air from fresh food chamber 122 can be directed into sub-compartment 162 such that ice-making assembly 160 or ice storage bin 164 is exposed to air from fresh food chamber 122.

In optional embodiments, liquid water generated during melting of ice cubes in ice storage bin 164, is directed out of ice storage bin 164. For example, turning back to FIG. 1, liquid water from melted ice cubes is directed to an evaporation pan 172. Evaporation pan 172 is positioned within a mechanical compartment 170 defined by housing 120, e.g., at bottom portion 102 of housing 120. A condenser 174 of the sealed system can be positioned, e.g., directly, above and adjacent evaporation pan 172. Heat from condenser 174 can assist with evaporation of liquid water in evaporation pan 172. A fan 176 configured for cooling condenser 174 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width or a depth of housing 120.

Access door 166 may be attached (e.g., latched or hinged) to refrigerator door 128. Generally, access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Separate from or in addition to icebox sub-compartment 162, refrigerator door 128 may define an interior compartment 210 within which a liquid reservoir 212 is mounted. For instance, one or more interior panels 214 defining at least a portion of interior surface 134 may attach to one or more panels or frame members of enclosing body 136, such as an internal mold 216. Internal mold 216 may thus be disposed between exterior surface 132 and interior surface 134.

When assembled, liquid reservoir 212 may be seated between internal mold 216 and interior panel 214. For instance, liquid reservoir 212 may include or be formed as a water tank supported on internal mold 216. Optionally, liquid reservoir 212 may be disposed at a portion of refrigerator door 128 that is lower than ice-making assembly 160, ice storage bin 164, or water dispenser 152 (e.g., at exterior surface 132).

Liquid reservoir 212 generally defines an enclosed cavity 222 within which water may be received. The enclosed cavity 222 may have a set and relatively large volumetric capacity (e.g., in comparison to conventional appliances). For instance, the enclosed cavity 222 may be greater than or equal to 0.5 liter, 1 liter, or 1.5 liters. Additionally or alternatively, the enclosed cavity 222 may be less than or equal to 3 liters. Notably, the interior compartment 210 and liquid reservoir 212 may be held within or directly adjacent to fresh food chamber 122 (e.g., when door 128 is in the closed position) to cool or maintain water within enclosed cavity 222 at a chilled temperature.

A reservoir inlet 224 may be defined through a wall of liquid reservoir 212 (e.g., at or proximal to a top end thereof). Separate (e.g., spaced apart) and downstream from reservoir inlet 224, a reservoir outlet 226 may be defined through a wall of liquid reservoir 212. Water may be permitted to flow from the enclosed cavity 222 through reservoir outlet 226. Optionally, reservoir outlet 226 may be located at or proximal to a bottom end of liquid reservoir 212, such as through a bottom wall of liquid reservoir 212. As shown, reservoir outlet 226 may be located at a lower height than reservoir inlet 224.

Downstream from the reservoir outlet 226, a liquid dispenser 230 extends from the liquid reservoir 212. Specifically, liquid dispenser 230 extends from liquid dispenser 230 and through the interior surface 134 (e.g., one or more interior panels 214 defining interior surface 134). Liquid dispenser 230 may include or be formed from one or more suitable water tubes or conduits that terminate at an outlet aperture 232 held at the opposite side of the exterior surface 132 from interior compartment 210. Thus, liquid dispenser 230 may pass through the interior compartment 210 from liquid reservoir 212 to a region or area that is outside of interior compartment 210 or refrigerator door 128, generally. In some such embodiments, the outlet aperture 232 is directed downward below the liquid reservoir 212. Liquid dispenser 230 itself may extend downward from liquid reservoir 212 (e.g., along the downstream flow path from the reservoir outlet 226). Water may thus flow from liquid reservoir 212 and through liquid dispenser 230 (e.g., as motivated by gravity). Advantageously, a separate pump may not be required or included to dispense water from liquid reservoir 212.

As shown, an open or unobstructed void may be defined directly beneath liquid dispenser 230 and outlet aperture 232. Notably, a wide variety of vessel sizes, shapes, and volumes may thus be accommodated to receive water from liquid dispenser 230. In some embodiments, liquid dispenser 230, and outlet aperture 232 are disposed below (e.g., at a lower height than) the ice-making assembly 160 or water dispenser 152. Thus, the ice-making assembly 160 or water dispenser 152 may be disposed above liquid dispenser 230. In certain embodiments, liquid dispenser 230 is configured to dispense water faster (e.g., at a higher volumetric flow rate) than water dispenser 152. For instance, both the outlet aperture 232 of liquid dispenser 230 and the water outlet 154 of the water dispenser 152 may each have a corresponding minimum cross-sectional area (e.g., defined by an opening diameter DW and DL, respectively) through which water may separately flow. In order to facilitate a faster or higher relative flow through liquid dispenser 230, the minimum cross-sectional area of the outlet aperture 232 may be greater than the minimum cross-sectional area of the water outlet 154.

One or more valves may be provided downstream from liquid reservoir 212 to control the flow or release of water from enclosed cavity 222 (e.g., through outlet aperture 232). Specifically, a release valve 234 may be mounted in fluid communication between liquid reservoir 212 (e.g., at least a portion of enclosed cavity 222) and outlet aperture 232. In other words, release valve 234 may be mounted downstream from liquid reservoir 212 (e.g., at reservoir inlet 224) and upstream from outlet aperture 232. For instance, release valve 234 may be mounted as on or within enclosed cavity 222. During use, release valve 234 may be moved or actuated (e.g., as directed by a user) to selectively release water from the liquid reservoir 212 through the liquid dispenser 230. In exemplary embodiments, release valve 234 may be provided as a manual release valve (e.g., manually actuated gate valve, butterfly valve, ball valve, etc.), which requires direct or indirect physical engagement (e.g., by a user) to selectively open or close the release valve 234 to permit or restrict the water flow through liquid dispenser 230.

A manual input 236 (e.g., button, flap, wheel, etc.) of the manual release valve 234 may be disposed on the refrigerator door 128 such that a user can actuate or move (e.g., open or close) the manual release valve 234. For instance, manual input 236 may extend through the interior surface 134, such as in the case of a button slidably disposed on an interior panel 214 to actuate the manual release valve 234 within interior compartment 210.

In certain embodiments, a level sensor 238 is mounted to the liquid reservoir 212. Specifically, level sensor 238 may be held on, within, or adjacent to liquid reservoir 212 to detect a water volume within the enclosed cavity 222. Thus, the level sensor 238 may be configured to detect the water volume within the liquid reservoir 212 (e.g., the amount of water as a volumetric value or as a generalized level that may be binarily achieved or unachieved). Generally, the level sensor 238 may be provided as any suitable sensor for detecting a volumetric value, a height, or a mass of water within enclosed cavity 222. For instance, level sensor 238 may include or be provided as an ultrasonic sensor, float sensor, reed switch, pressure sensor, or capacitive sensor (e.g., at one or more predetermined heights within enclosed cavity 222). In some embodiments, the level sensor 238 may be configured with a preset detection level and, thus, may detect if and when the water volume within the enclosed cavity 222 reaches the preset detection level. In additional or alternative embodiments, the level sensor 238 is in operable (e.g., wired or wireless) communication with controller 190 to transmit or receive one or more signals therefrom. For instance, the controller 190 may be configured to receive one or more level signals from the level sensor 238 in response to the water volume within enclosed cavity 222 reaching the preset detection level.

When assembled, liquid reservoir 212 may be in downstream fluid communication with the water source of refrigerator appliance 100. For instance, one or more intermediate conduits 240 may connect the water source to the liquid reservoir 212 at the reservoir inlet 224, as would be understood. In some such embodiments, liquid reservoir 212 is in fluid isolation from ice-making assembly 160 or water dispenser 152. Thus, water received within the liquid reservoir 212 may generally be kept separate from any water received or used by ice-making assembly 160 or water dispenser 152. Upstream from the liquid dispenser 230, a water valve 218 may be mounted to selectively direct water to the enclosed cavity 222 from the water source. In other words, water valve 218 may be mounted (e.g., within the refrigerator door 128 or refrigerator appliance 100, generally) upstream from the liquid reservoir 212 to selectively direct water to the liquid reservoir 212. In some embodiments, water valve 218 is in operable (e.g., wired or wireless) communication with controller 190 to transmit or receive one or more signals therefrom. For instance, controller 190 may be configured to direct or control the position of water valve 218 (e.g., to open and close water valve 218). Optionally, controller 190 may be configured to direct water valve 218 based on one or more signals received from the level sensor 238. As an example, controller 190 may direct the water valve 218 to an open position, permitting water to the liquid reservoir 212, unless or until a level signal is received from the level sensor 238 to indicate that the preset detection level is met. In other words, controller 190 may close the water valve 218 in response to the preset detection level being met. Once the water level falls back below the preset detection, controller 190 may direct the water valve 218 to reopen. Thus, the controller 190 may generally direct the water valve 218 to maintain or resupply water to the preset detection level within the enclosed cavity 222.

Advantageously, assemblies or appliances in accordance with the above embodiments may be capable of efficiently or reliably supplying chilled water to a user (e.g., at relatively large volumes or without requiring significant sacrifices to complexity, cost, or storage space for a fresh food chamber 122).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator door assembly comprising:

an enclosing body defining an exterior surface and an interior surface;

a liquid reservoir defined within the enclosing body between the exterior surface and the interior surface;

a level sensor mounted to the liquid reservoir, the level sensor being configured to detect a water volume within the liquid reservoir;

a water valve mounted upstream from the liquid reservoir to selectively direct water thereto based on the detected water volume;

a liquid dispenser extending from the liquid reservoir and through the interior surface to an outlet aperture to selectively dispense water from the liquid reservoir; and a water dispenser mounted on the enclosing body and extending through the exterior surface, wherein the water dispenser is in fluid isolation from the liquid reservoir.

2. The refrigerator door assembly of claim 1, further comprising:

a manual release valve mounted in fluid communication between the liquid reservoir and the outlet aperture to selectively release water from the liquid reservoir through the liquid dispenser.

3. The refrigerator door assembly of claim 2, wherein the manual release valve comprises a manual input extending through the interior surface to actuate the manual release valve.

4. The refrigerator door assembly of claim 1, further comprising:

an icemaker mounted within the enclosing body in fluid isolation from the liquid reservoir.

5. The refrigerator door assembly of claim 4, wherein the icemaker is disposed above the liquid dispenser.

6. The refrigerator door assembly of claim 1, wherein the water dispenser defines a water outlet having a minimum cross-sectional area through which water may flow, wherein the outlet aperture has a minimum cross-sectional area through which water may flow, and wherein the minimum cross-sectional area of the outlet aperture is greater than the minimum cross-sectional area of the water outlet.

7. The refrigerator door assembly of claim 6, wherein the water dispenser is disposed above the liquid dispenser.

8. The refrigerator door assembly of claim 1, wherein the outlet aperture is directed downward below the liquid reservoir.

9. A refrigerator appliance comprising:

a cabinet defining a chilled chamber;

an enclosing body mounted to the cabinet, the enclosing body defining an exterior surface directed away from the chilled chamber and an interior surface directed toward the chilled chamber;

a liquid reservoir defined within the enclosing body between the exterior surface and the interior surface;

a level sensor mounted to the liquid reservoir, the level sensor being configured to detect a water volume within the liquid reservoir;

a water valve mounted within the refrigerator appliance upstream from the liquid reservoir to selectively direct water thereto based on the detected water volume;

a liquid dispenser extending from the liquid reservoir and through the interior surface to an outlet aperture to selectively dispense water from the liquid reservoir; and a water dispenser extending through the exterior surface, wherein the water dispenser is in fluid isolation from the liquid reservoir.

10. The refrigerator appliance of claim 9, further comprising:

a manual release valve mounted in fluid communication between the liquid reservoir and the outlet aperture to selectively release water from the liquid reservoir through the liquid dispenser.

11. The refrigerator appliance of claim 10, wherein the manual release valve comprises a manual input extending through the interior surface to actuate the manual release valve.

12. The refrigerator appliance of claim 9, further comprising an icemaker mounted within the refrigerator appliance in fluid isolation from the liquid reservoir.

13. The refrigerator appliance of claim 12, wherein the icemaker is disposed above the liquid dispenser.

14. The refrigerator appliance of claim 9, wherein the water dispenser defines a water outlet having a minimum cross-sectional area through which water may flow, wherein the outlet aperture has a minimum cross-sectional area through which water may flow, and wherein the minimum cross-sectional area of the outlet aperture is greater than the minimum cross-sectional area of the water outlet.

15. The refrigerator appliance of claim 14, wherein the water dispenser is disposed above the liquid dispenser.

16. The refrigerator appliance of claim 9, wherein the outlet aperture is directed downward below the liquid reservoir.

17. A refrigerator door assembly comprising:

an enclosing body defining an exterior surface and an interior surface;

a liquid reservoir defined within the enclosing body between the exterior surface and the interior surface;

a level sensor mounted to the liquid reservoir, the level sensor being configured to detect a water volume within the liquid reservoir;

a water valve mounted upstream from the liquid reservoir to selectively direct water thereto based on the detected water volume;

a liquid dispenser extending from the liquid reservoir and through the interior surface to an outlet aperture to selectively dispense water from the liquid reservoir; and a water dispenser mounted on the enclosing body apart from and in fluid isolation from the liquid dispenser.

18. The refrigerator door assembly of claim 17, wherein the water dispenser defines a water outlet having a minimum cross-sectional area through which water may flow, wherein the outlet aperture has a minimum cross-sectional area through which water may flow, and wherein the minimum cross-sectional area of the outlet aperture is greater than the minimum cross-sectional area of the water outlet.

19. The refrigerator door assembly of claim 17, wherein the water dispenser is disposed above the liquid dispenser.

20. The refrigerator door assembly of claim 17, wherein the outlet aperture is directed downward below the liquid reservoir.

* * * * *